United States Patent [19]

Sutch

[11] Patent Number: 4,561,194

[45] Date of Patent: Dec. 31, 1985

[54] HAY DRYING FACILITY

[75] Inventor: George T. Sutch, Yuma, Ariz.

[73] Assignee: Lawrence K. Bingham, Yuma, Ariz. ; a part interest

[21] Appl. No.: 672,665

[22] Filed: Nov. 19, 1984

[51] Int. Cl.[4] ..... F26B 9/02

[52] U.S. Cl. ..... 34/229; 34/233

[58] Field of Search ..... 34/232, 233, 224, 225, 34/229; 98/55

[56] References Cited

U.S. PATENT DOCUMENTS

| | | | |
|---|---|---|---|
| 1,981,436 | 11/1934 | Shodron | 98/55 |
| 2,601,728 | 7/1952 | Erfurth | 98/55 |
| 2,634,673 | 4/1953 | Maho | 98/55 |
| 2,722,058 | 11/1955 | Heal | 34/232 |
| 3,136,240 | 6/1964 | Rabe | 34/232 |
| 4,458,428 | 7/1984 | Saeman | 34/232 |

*Primary Examiner*—Larry I. Schwartz

*Attorney, Agent, or Firm*—Cahill, Sutton & Thomas

[57] ABSTRACT

A facility for forcing warm air uniformly through hay layered on a flat surface. Air forced through distribution channels beneath the surface is directed upwardly through a plurality of spaced upright, tubular supply duct formers which controllably distribute the air into the hay. A plurality of tubular, foraminous vent duct formers are distributed throughout the hay at spaced locations intermediate the supply duct formers. The vent duct formers provide low resistance escape paths for some of the drying air with the result that the drying air flows substantially horizontally through the hay from the supply ducts to the vent ducts formed in the hay, assuring uniform drying of the hay. Both the supply duct formers and the vent duct formers may be equipped with valves to control the flow of air therethrough. The supply duct former is adapted to be lifted to an elevated position when a new layer of hay is deposited on an already dried layer. The vent duct former is preferably of a height to accommodate several layers of hay. All of the supply duct formers and the vent duct formers are removable from the hay to simplify removal of dried hay from the facility.

7 Claims, 7 Drawing Figures

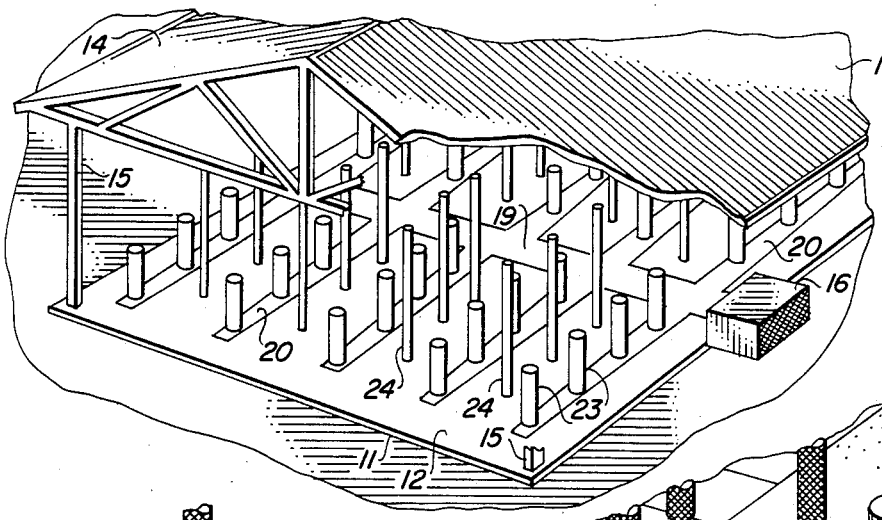
FIG-1
FIG-2
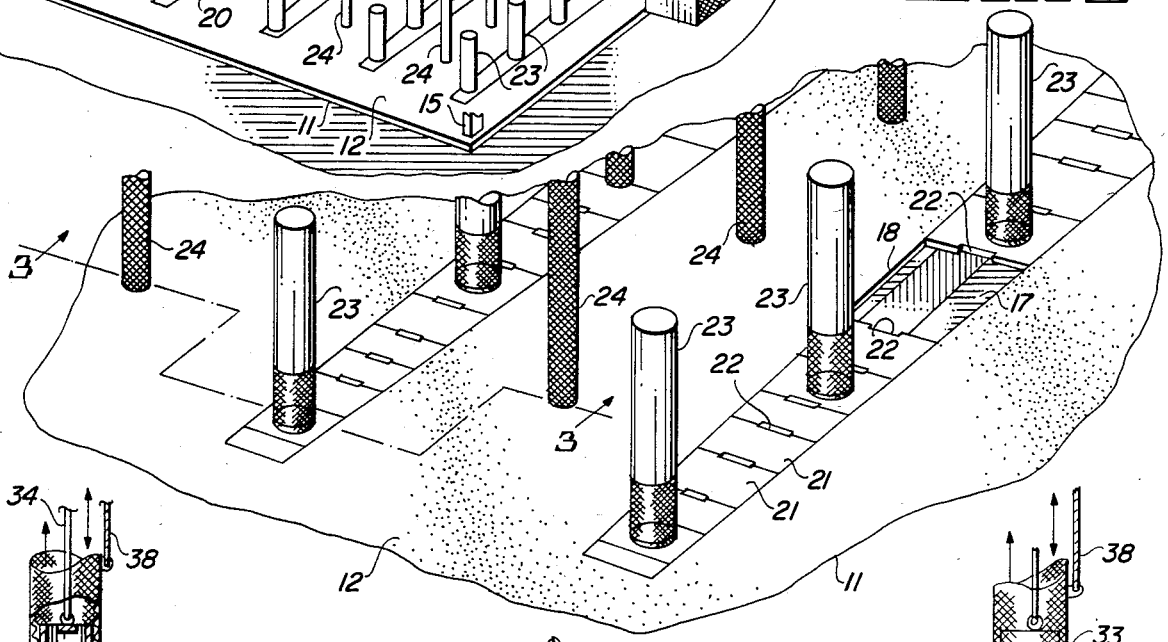
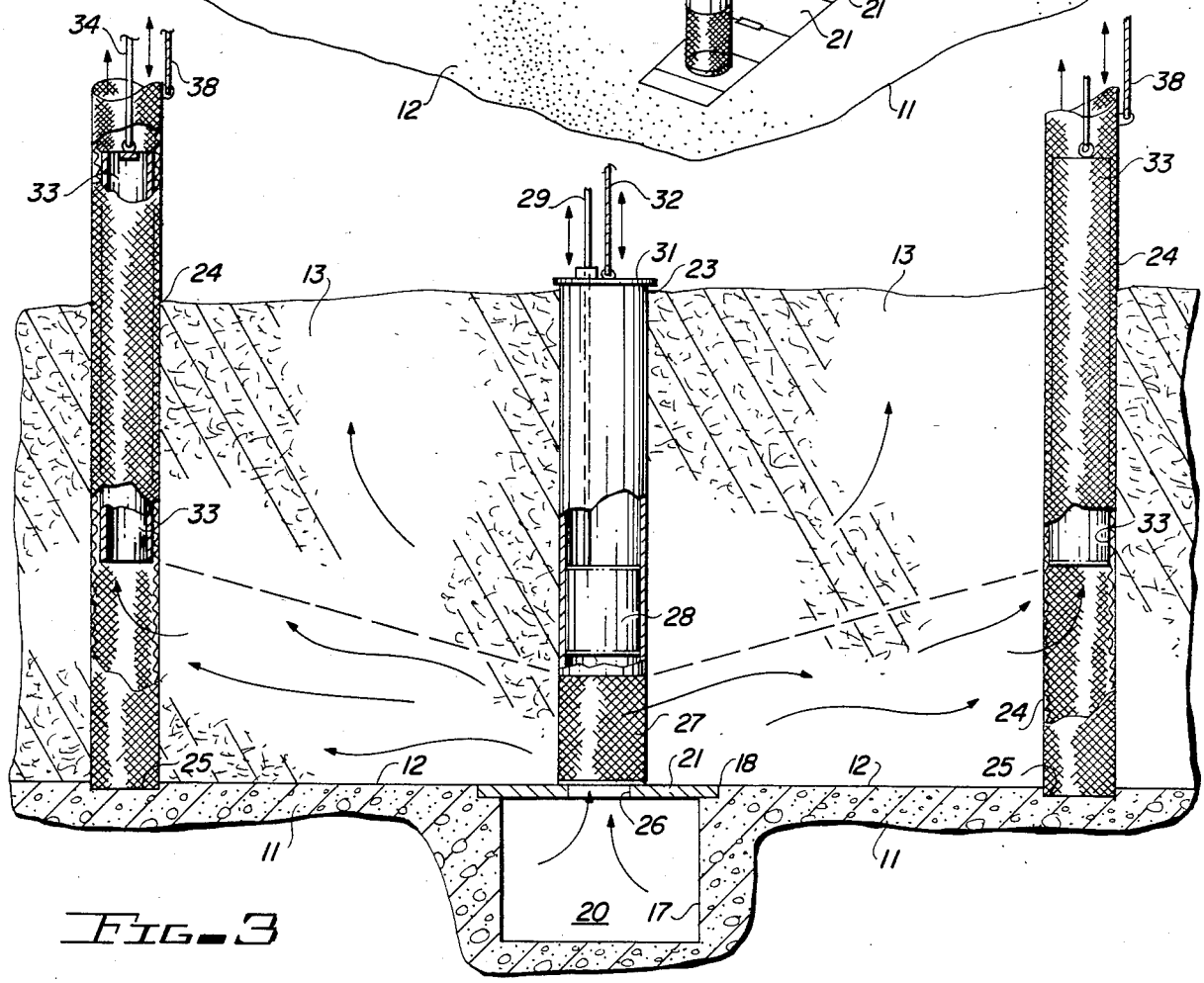
FIG-3

HAY DRYING FACILITY

TECHNICAL FIELD

This invention is concerned with improving the quality of forage through controlled drying of the crop following harvesting.

BACKGROUND ART

The centuries-old practice of drying cut forage crops in the field prior to storage usually results in the production of very low quality hay. Such a procedure subjects the crops to uncontrolled natural elements, such as sun, rain and variable temperatures, which attack and decompose the crop. As a result, many of the nutrients in the crop, such as the xantophylls, carotene, chlorophyll and the very important proteins, are lost in the drying process.

And, yet, these crops cannot be stored in the wet condition they are in immediately following cutting. Such storage prompts rotting and molding of the hay and can even result in spontaneous combustion. So numerous proposals have been made for artificially drying the hay either prior to or during storage. One hay drying device, which exemplifies prior efforts to improve the quality of hay, is disclosed in U.S. Pat. No. 2,602,728, granted July 1, 1952, to Herman C. Erfurth for "Hay Drying Device". The Erfurth apparatus is adapted to be installed in a barn loft, hay mow or hay stack to direct heated streams of drying air into hay stacked over and around the apparatus. A plurality of cylindrical flue formers are disposed at spaced intervals in a layer of hay and receive air under pressure through flue feeder channels in the layer of hay. Drying air exiting the flue formers and the feeder channels is allowed to percolate upwardly through the layers of hay, gathering moisture which is then carried to the atmosphere. As additional layers of hay are stacked above the dried layer or layers the flue formers are raised to form air flow flues in the new layers.

One of the problems with the Erfurth hay drying apparatus and others like it is that it provides no means for controlling the flow of drying air through the layer of hay. The natural upward percolation of drying air exiting the flues and the flue feeder channels results in very little lateral dispersion of the drying air. Consequently, regions of the hay layer remote from a flue of a feeder channel may receive little or no air flow. In addition, regions of the hay layer which happen to be more tightly packed than other regions similarly are deprived of any flow of drying air. The result is a layer of hay with very uneven drying throughout. Those undried regions of hay are subject to deterioration through molding or combustion.

Furthermore, the Erfurth apparatus is designed to rest on and project above the surface on which the hay to be dried is placed. Thus, the apparatus is in the way of and interferes with removal of the dried hay.

There continues to be a need, therefore, for a hay drying facility capable of uniformly and controllably drying the hay in such manner that there is maximum retention of the nutrients in the hay.

DISCLOSURE OF INVENTION

The hay drying facility of this invention has a generally flat surface beneath which are a plurality of warm air distribution channels capable of directing air upwardly through a plurality of spaced upright tubular supply duct formers distributed throughout the hay layer on the surface. The supply duct formers create ducts in the hay layer and controllably distribute the air flowing therethrough into the hay. A plurality of tubular, foramenous vent duct formers are distributed throughout the hay at spaced locations intermediate the supply duct formers to provide low resistance escape paths for some of the drying air flowing through the hay. Although some of the drying air flowing from the supply ducts toward the vent ducts percolates upwardly through the layer of hay, a significant quantity of the air is caused to flow substantially horizontally through the hay to the vent ducts. This arrangement assures even distribution of the drying air throughout the hay.

It is preferred that each of the vent duct formers be equipped with means for selectively opening and closing the foramens in the former to selectively establish the size of the flow path into the vent duct. The supply duct former likewise is preferably equipped with a valve means for controlling the quantity and/or direction of air flow from the supply duct.

The supply duct former preferably has a height approximately equal to the thickness of a layer of hay to be dried in the facility and as additional layers are placed atop a dried layer the supply duct former is moved vertically, i.e. lifted, to form the supply duct in the newly laid layers. The vent duct former, on the other hand, is generally required to be stationary throughout the layering and drying procedure and, therefore, has a height approximately equal to the maximum number of layers of hay to be dried in the facility.

Lastly, a further feature of the invention is the removability of both the supply duct formers and the vent duct formers from the dried hay to simplify removal of the dried hay from the drying facility. In other words, with the formers removed, hay handling equipment can be moved unobstructably across the drying surface of the facility to pick up and move the dried hay.

BRIEF DESCRIPTION OF THE DRAWINGS

This invention is described in greater detail hereinafter by reference to the accompanying drawings, wherein:

FIG. 1 is a fragmentary three-quarter perspective view from above of a hay drying facility constructed in accordance with this invention and wherein a portion of the roof structure has been broken away to reveal more of the interior of the facility;

FIG. 2 is an enlarged three-quarter perspective view of a portion of the facility shown in FIG. 1;

FIG. 3 is a vertical sectional view through a portion of the drying facility, taken generally as indicated by line 3—3 in FIG. 2;

BEST MODES FOR CARRYING OUT THE INVENTION

Figure 4:
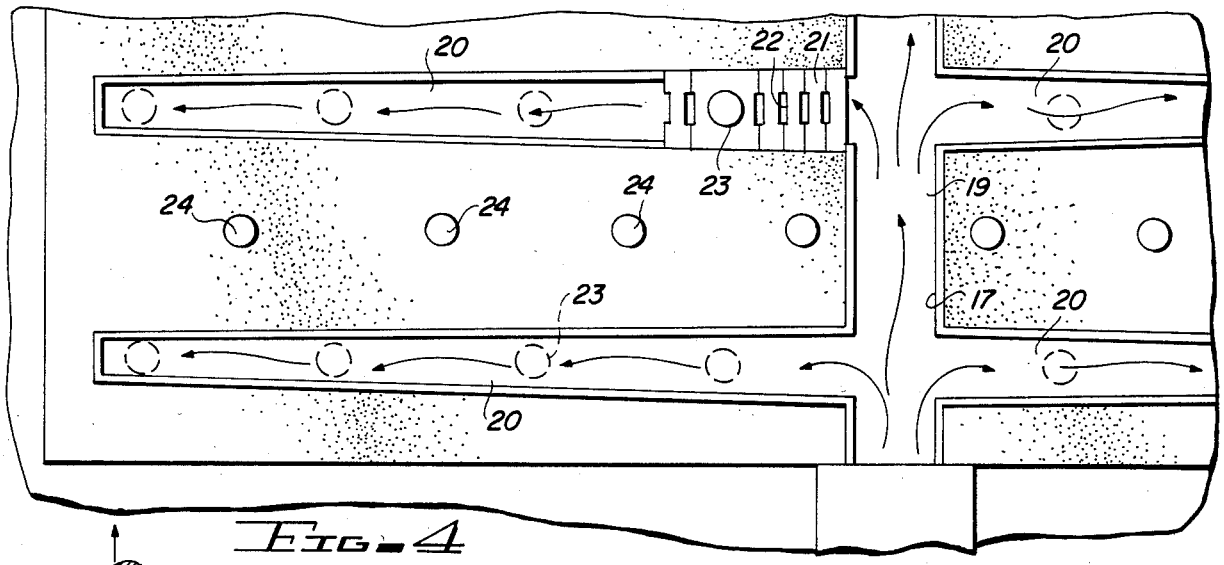
FIG. 4 is a plan view of a portion of a drying facility showing air distribution channels located beneath the surface of the facility.

FIG. 1 illustrates a hay drying facility constructed in accordance with this invention and showing the facility as it might appear from the air. The principal components of the facility include a concrete slab 11 providing a flat surface 12 on which hay 13 to be dried is distributed. If desired, the hay being dried can be protected from the elements by a roof structure 14 supported by posts 15 at the corners of the concrete slab 11. A facility utilizing air as the drying medium preferably has no sidewalls to facilitate ingress and egress of hay. It is contemplated that the hay drying facility will be constructed at some convenient central location in a forage crop growing area and that freshly cut hay, preferably cut no more than a few hours beforehand, will be transported to the facility for drying and once dried will be transferred elsewhere for storage.

Actual drying of the hay 13 is accomplished by passing a heated fluid, such as air or nitrogen, through a layer of hay 13 disposed on surface 12. For reasons of economy, air is the preferred drying medium, although, as discussed hereinafter, the use of an inert gas such as nitrogen has some advantages. Air is heated and supplied under pressure by means of a motor driven blower heater unit indicated generally at 16. Details of unit 16 are not disclosed here because the components thereof are conventional and well understood by those skilled in the art. It has been determined that the air should be heated to a temperature in the range of 105° to 120° Fahrenheit for effective drying of the hay with minimum loss of nutrients.

Heated air from unit 16 is conveyed throughout the drying facility in a series of distribution channels 17 cast into slab 11 and having top openings 18 flush with the hay supporting surface 12 (see FIGS. 2 and 3). One possible arrangement of distribution channels 17 is illustrated in FIGS. 1 and 4 involving a central supply channel 19 receiving air from blower heater unit 16 and a plurality of lateral channels 20 adapted to distribute air from central supply channel 19 throughout the facility. A typical installation utilizing this invention can employ a central channel 19 having a three ft. by five ft. cross section feeding laterals which have a cross section of approximately three ft. by three ft. and are spaced on ten ft. centers along the central supply channel. If desired, the lateral channels 20 can be tapered from their inlet ends to their closed ends near the edges of slab 11 (see FIG. 4).

Disposed within the top openings 18 of the distribution channels 17 are a series of removable covers, or plates, 21 which have their edges slotted as indicated at 22 to permit air to flow out of the channels into the layer of hay placed on the surface 12. Covers 21 may conveniently and economically be made of wood.

Unlike prior drying facilities, the facility of this invention does not merely rely upon warm air issuing from the channels 17 through the series of slots 22 and percolating upwardly through the layer of hay 13. This invention provides means for specifically directing and controlling the flow of drying air through the hay layer. This control of air flow is accomplished by means of a plurality of supply duct formers 23 and a plurality of vent duct formers 24. The supply duct formers 23 are positioned within the layer of hay 13 at spaced locations above the lateral channels 20 and receive air from these channels through enlarged openings 26 in selected channel covers 21 (see FIG. 3). Supply duct formers 23 are so called because they are tubular in cross section and have spaced walled regions which are capable of forming duct-like regions in the hay layer 13 through which drying air can enter the hay layer. Each supply duct former 23 has a foramenous lower section 27 formed of wire or plastic screen which permits air to leave the duct former and enter the layer of hay 13. Each supply channel former 23 is also preferably equipped with a valve plug 28 closely fitting but slidingly movable axially within the tubular interior of the former. A manipulating rod 29 attached to each valve plug 28 allows the operator of the facility to raise or lower plug 28 to block off portions of foramenous lower section 27 of each supply duct former 23 to control the air flow area from the supply duct former. Each supply duct former 23 is also preferably equipped with an enlarged cover plate 31 at its upper end and has a lifting cable 32 providing means for elevating the supply duct former as additional layers of hay are added to the facility.

The vent duct formers 24 are so named because they are capable of forming within the layer of hay 13 ducts which provide low resistance escape paths for some of the drying air which is discharged into the hay 13. Each vent duct former 24 comprises an upright elongated tubular member having spaced walls formed of foramenous material, such as wire or plastic screen, and a means for controlling the number of foramens, or openings, which are open for entry of air flowing through the hay. This later means preferably takes the form of a tubular slide valve 33 disposed for sliding axial movement in each duct former 24. As can be readily appreciated by viewing FIG. 3, raising or lowering a slide valve 33 in a vent duct former 24, as by means of an overhead cable 34, adjusts the extent to which the lower sections of that duct former 24 is uncovered or covered by the valve 33.

The vent duct formers 24 are adapted to rest on surface 12 of concrete slab 11 in spaced locations intermediate the locations of the supply duct formers 23. If desired, slight depressions 25 can be provided in the slab 11 to assist in locating the vent duct formers. Preferably, the distance between any one vent duct former 24 and the nearest supply duct former 23 is approximately the same as or less than the height of the layer of hay 13 to be dried. By this arrangement there is established a preferential air flow path from the foraminous lower sections 27 of the supply duct formers 23 to those portions of duct formers 24 which are left exposed by slide valves 33. This ensures a uniform, generally horizontal flow of drying air through the lower regions of the layer of hay 13 to promote drying of that portion of the layer. As the drying sequence progresses, the operator of the facility can move the tubular slide valves 33 upwardly in the vent duct formers 24 to expose a greater depth of the layer of hay 13 to this somewhat horizontal flow pattern. Of course, some of this drying air will percolate vertically upwardly through the layer of hay 13, as indicated by arrows in FIG. 3, so all regions of the hay layer are dried uniformly.

The drying cycle for a layer of hay in this facility likely will take several hours because the drying is performed at only slightly elevated temperatures to preserve the nutrients in the forage. During this time the operators of the facility can measure the temperature and moisture conditions of the hay at various locations throughout the layer by means of probes. If it assertained that any particular regions are not receiving appropriate quantities of drying air, the valve structures of the supply duct formers 23 and the vent duct formers 24 in the vicinity of that region can be adjusted to give the appropriate air flow. Similar adjustments can be made to reduce the flow of air if it appears that some regions are drying more quickly than the bulk of the hay layer.

Figure 5:
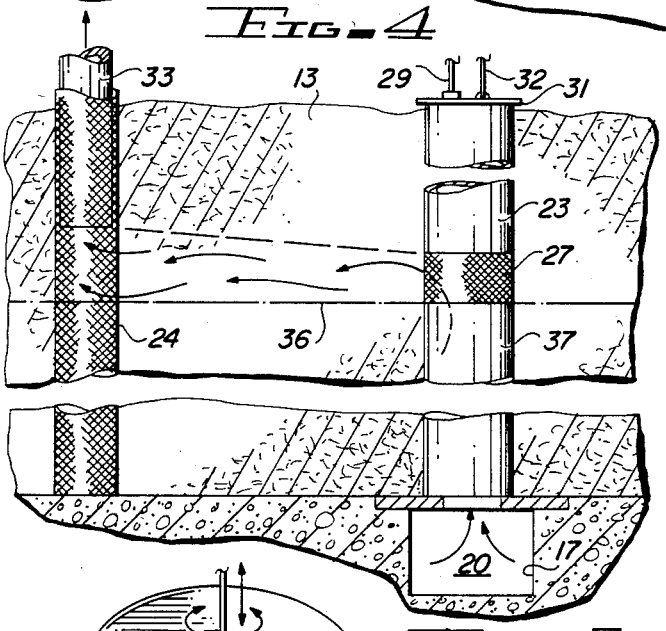
FIG. 5 is a sectional view similar to FIG. 3 but illustrating the position of the duct forming components when an additional layer of hay has been distributed in the facility over a previously dried layer.

To obtain full utilization of the hay drying facility, it is contemplated that when a layer of hay 13 has been dried on slab 11 a second layer of hay be placed on top of the dried layer and the drying process continued. This sequence can be repeated until several layers of hay, which essentially fill the facility, have been dried. In accordance with this invention the vent duct formers 24 are of a height to accommodate the maximum number of layers of hay to be dried in the facility. However, the invention contemplates utilization of shorter, more compact and less expensive supply duct formers 23 which are raised from the dried layer into the newly-laid layer of hay. The manner in which this is carried out is illustrated in FIG. 5 wherein the dot and dash line 36 is the demarcation line between a lower, completely dried layer of hay 13 and a newly applied upper layer of hay which is in the process of being dried. It is to be noted that supply duct former 23 has been raised so that it is surrounded by the upper, drying layer of hay with the periphery of its enlarged cover plate 31 resting on the upper surface of the hay layer.

The lower layer of hay 13, by virtue of having been dried, has settled and compacted with two benefits being derived from this condition. The first benefit is that the walls of the supply duct 37 in the lower level of the hay have become self supporting so that the supply duct former 23 can be lifted into the new layer without the originally formed supply duct 37 collapsing. Secondly, the dried and compacted lower layer of hay 13 offers substantially more resistance to air flow than the less compact upper layer undergoing drying. So, the drying air is confined to flow through supply duct 37 to the foramenous lower section 27 of the elevated supply duct former 23, where it exits into the layer of undried hay. The drying action on this upper layer, then, is essentially the same as the drying action that took place for the lower layer of hay.

When all of the desired layers of hay 13 have been dried and the facility is considered to be filled, all of the supply duct formers 23 and the vent duct formers 24 are preferably removed from the stack of hay. This can be accomplished by lifting these items into the upper portion of the facility structure utilizing lifting cable 32 for each supply duct former 23 and a similar lifting cable 38 for each vent duct former 24. With the duct formers 23 and 24 out of the way, the surface 12 of the drying facility is unobstructed and equipment for lifting and transporting the dried hay can move about freely on that surface. This is, of course, made possible in part by the fact that the distribution channels 17 are formed beneath surface 12 and the covers 21 for these distribution channels are generally flush with the surface 12.

Although numerous modifications and variations of the apparatus incorporated in this hay drying facility can be envisioned which fall within the scope and spirit of this invention, several possible modifications are believed to be worthy of mention. Two of these are shown in FIGS. 6 and 7.

Figure 6:
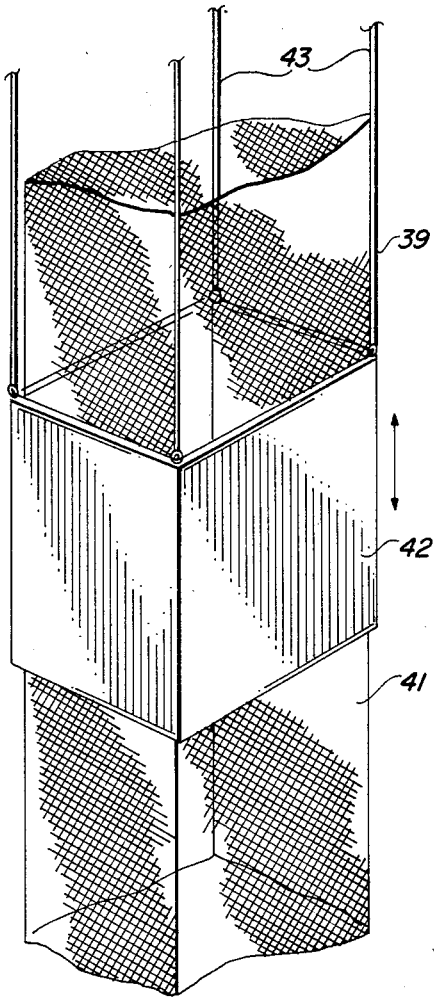
FIG. 6 is a partial perspective view of a modified form of vent duct former utilized in the facility.

A modified vent duct former 39 is illustrated in FIG. 6 and comprises a tubular, foramenous member 41, in this case having a rectangular cross section, and a mating tubular sleeve 42, also having a rectagular cross section. The sleeve 42 is made of solid material and can be moved up and down on tube 41 to control the amount of openings therein which are exposed to the air flowing through the hay. Any suitable means, such as cables 42, can be utilized to manipulate the sleeve 42 in the same manner and for the same purpose as the tubular slide valve 33 was manipulated for duct formers 24, described above.

Figure 7:
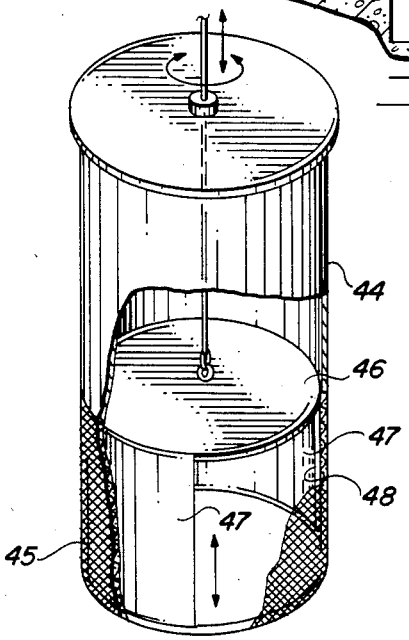
FIG. 7 is a perspective view with portions broken away of a modified supply duct former utilized in the facility.

A modified supply duct former 44 is illustrated in FIG. 7. This component of the drying facility has a main tubular body and a foramenous lower section 45 like the supply duct formers 23 described above. However, disposed within the tubular body of the modified supply duct 44 is a valve member 46 having a cylindrical skirt 47 with a longitudinal slot 48 therein. Depending upon the requirements of the particular supply duct former 44 the valve member 46 may have a slot anywhere from one quarter to one half of the circumference of the skirt to direct the air outwardly over a limited area of the surrounding hay. The modified duct former 44 is equipped with a manipulating rod 49 attached to valve member 46 and extending through the top of the former. By means of manipulating rod 49 the valve member 46 can be raised, lowered and turned to control the direction and quantity of air flow through the lower section 45 of the former. Such adjustments are made for the purpose of directing air into those regions of the layers of hay 13 which require additional drying air.

As mentioned previously, it is also possible to utilize an inert gas, such as nitrogen, as the drying medium for extracting moisture from the hay. Ambient air sometimes contains contaminates, as might emanate from nearby industrial or power plant facilities. And such contaminates can react adversely with and deteriorate the hay. Pure nitrogen should contain no such contaminates and if used can produce a superior hay. The use of nitrogen is, of course, more expensive. First, there is the cost of the purified gas itself. And to minimize that cost it is desirable to completely enclose the drying facility and provide means for dehydrating and recirculating the nitrogen gas. This increases the capital cost of the facility.

I claim:

1. A hay drying facility comprising means providing a substantially flat surface for supporting hay to be dried, a plurality of generally upright supply duct formers adapted to be disposed at spaced locations throughout the hay to be dried, said supply duct formers having spaced wall regions for creating a duct in the hay to admit a drying fluid to the hay, channel means disposed beneath said hay supporting surface for supplying a drying fluid to said supply duct formers, and a plurality of generally upright vent duct formers adapted to be disposed at spaced locations intermediate said supply duct formers, said vent duct formers having spaced foraminous wall regions for creating a duct in the hay to permit escape of some of the drying fluid therethrough upwardly from the hay, said supply duct formers and said vent duct formers being movable away from said hay supporting surface to clear said surface and facilitate removal of dried hay from said surface.

2. The hay drying facility of claim 1 including means for adjustably closing the foramens in said vent duct formers to control the passage of drying fluid into the vent duct.

3. The hay drying facility of claims 1 or 2 including valve means for controlling the flow of drying fluid out of said supply duct formers.

4. The hay drying facility of claims 1 or 2 wherein the means for supplying the drying fluid is disposed beneath said hay supporting surface.

5. The hay drying facility of claims 1 or 2 wherein means are provided for lifting said supply duct formers as a layer of hay is added atop an existing layer and said vent duct formers are of a height sufficient to accommodate a plurality of layers of hay.

6. The hay drying facility of claims 1 or 2 wherein said channel means for supplying the drying fluid has an opening through said hay supporting surface and the facility includes means for removably covering the opening of said channel, said covering means being flush with said hay supporting surface.

7. The hay drying facility of claim 1 wherein a lower region of said supply duct formers are made of foraminous material.

* * * * *